US008274541B2

(12) United States Patent
Yoo

(10) Patent No.: US 8,274,541 B2
(45) Date of Patent: Sep. 25, 2012

(54) LIGHT SCANNING UNIT HAVING THERMAL EXPANSION CONTROL UNIT

(75) Inventor: Byoung-Ho Yoo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 91 days.

(21) Appl. No.: 12/761,108

(22) Filed: Apr. 15, 2010

(65) Prior Publication Data

US 2011/0074908 A1 Mar. 31, 2011

(30) Foreign Application Priority Data

Sep. 28, 2009 (KR) ..... 10-2009-0091780

(51) Int. Cl.
*B41J 15/14* (2006.01)
*B41J 27/00* (2006.01)

(52) U.S. Cl. ..... 347/242; 347/257

(58) Field of Classification Search ..... 347/224, 347/225, 242, 257, 263
See application file for complete search history.

(56) References Cited

U.S. PATENT DOCUMENTS 7,397,492 B2 * 7/2008 Yamagata ..... 347/242
7,453,615 B2 * 11/2008 Nakajima ..... 359/198.1

FOREIGN PATENT DOCUMENTS

JP 08050861 A * 2/1996
JP 2001-264666 9/2001

* cited by examiner

*Primary Examiner* — Hai C Pham
(74) *Attorney, Agent, or Firm* — Staas & Halsey LLP

(57) ABSTRACT

A light scanning unit including: a housing including optical components disposed on an optical path, wherein an electrostatic latent image is formed by scanning light beams respectively onto a plurality of photosensitive drums, wherein a plurality of slits are formed, in a sub-scan direction, in both side frames of the housing which face each other; and a thermal expansion control unit disposed on both of the side frames and having a lower thermal expansion coefficient than the thermal expansion coefficient of the housing. Since the change of the scan line due to the thermal deformation may be reduced in the light scanning unit, the light scanning unit may be efficiently applied to electrophotographic imaging apparatuses in any orientation. For example, the light scanning unit may be installed in an electrophotographic imaging apparatus so as to be parallel to or perpendicular to the main body of the electrophotographic imaging apparatus.

18 Claims, 8 Drawing Sheets

LIGHT SCANNING UNIT HAVING THERMAL EXPANSION CONTROL UNIT

CROSS-REFERENCE TO RELATED APPLICATIONS

This application claims the benefit of Korean Patent Application No. 10-2009-0091780, filed on Sep. 28, 2009, in the Korean Intellectual Property Office, the disclosure of which is incorporated herein in its entirety by reference.

BACKGROUND

1. Field

The present general inventive concept relates to a light scanning unit.

2. Description of the Related Art

In electrophotographic imaging apparatuses, an image is formed by scanning light beams onto a surface of a photosensitive drum using a light scanning unit to form an electrostatic latent image, developing the electrostatic latent image using a developing agent, such as toner, to form a developed image, transferring the developed image onto a printing medium, and fusing the transferred developed image onto the printing medium.

A light scanning unit used in an electrophotographic imaging apparatus is fabricated by assembling optical components onto a plastic injection-molded frame. However, the plastic thermally expands as the temperature increases during a printing process, thereby deforming a scan line.

Since the deformation of the scan line may deteriorate the quality of an image, there is a need to perform an automatic color registration that compensates for the deformed scan line. However, the automatic color registration delays the printing time, and frequent automatic color registration may cause inconveniences.

SUMMARY

Additional aspects and/or advantages will be set forth in part in the description which follows and, in part, will be apparent from the description, or may be learned by practice of the invention.

The present general inventive concept provides a light scanning unit providing excellent image quality by reducing the change of a scan line according to a temperature increase during a printing process and improving reliability by reducing the frequency of automatic color registration.

According to an aspect, there is provided a light scanning unit including: a housing including optical components disposed on an optical path, wherein an electrostatic latent image is formed by scanning light beams respectively onto a plurality of photosensitive drums, wherein a plurality of slits are formed, in a sub-scan direction, in both side frames of the housing which face each other; and a thermal expansion control unit disposed on both of the side frames and having a lower thermal expansion coefficient than a thermal expansion coefficient of the housing.

The thermal expansion control unit may be fixed to each external sub-frame portion among a plurality of sub-frame portions partitioned by the plurality of slits.

The light scanning unit may further include an auxiliary thermal expansion control unit disposed closer to the photosensitive drums than the thermal expansion control unit and having a greater thermal expansion coefficient than a thermal expansion coefficient of the housing.

The light scanning unit may further include an auxiliary thermal expansion control unit disposed farther from the photosensitive drums than the thermal expansion control unit and having the same thermal expansion coefficient as a thermal expansion coefficient of the thermal expansion control unit.

The auxiliary thermal expansion control unit may be fixed to each internal sub-frame portion among a plurality of sub-frame portions partitioned by the plurality of slits.

The thermal expansion control unit may be fixed to each of a plurality of sub-frame portions partitioned by the plurality of slits.

A plurality of thermal expansion control units may be symmetrically disposed based on the slit disposed at the center of the side frame.

The light scanning unit may further include an auxiliary thermal expansion control unit disposed farther from the photosensitive drums than the thermal expansion control unit and having the same thermal expansion coefficient as a thermal expansion coefficient of the thermal expansion control unit.

The auxiliary thermal expansion control unit may be fixed to each internal sub-frame portion among a plurality of sub-frame portions partitioned by the plurality of slits.

A slit may be formed in both of the side frames on which the auxiliary thermal expansion control unit is disposed such that the slit corresponds to the center of the auxiliary thermal expansion control unit.

The light scanning unit may further include a cover formed of steel and covering the lower surface of the housing to inhibit thermal deformation of the housing.

The length of the auxiliary thermal expansion control unit may be about ½ of the length of the side frame.

The plurality of slits may be formed each between every two adjacent two light beams respectively emitted by the plurality of photosensitive drums.

The depth of the slits may be in the range of about ¼ to about ⅔ of the height of the side frame.

According to another aspect of the present general inventive concept, there is provided a light scanning unit including: a housing including optical components disposed on an optical path, wherein an electrostatic latent image is formed by scanning light beams respectively onto a plurality of photosensitive drums, wherein a plurality of slits are formed in both side frames of the housing which face each other; and a thermal expansion control unit disposed in the housing facing each other in a sub-scan direction and having a different thermal expansion coefficient from a thermal expansion coefficient of the housing.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
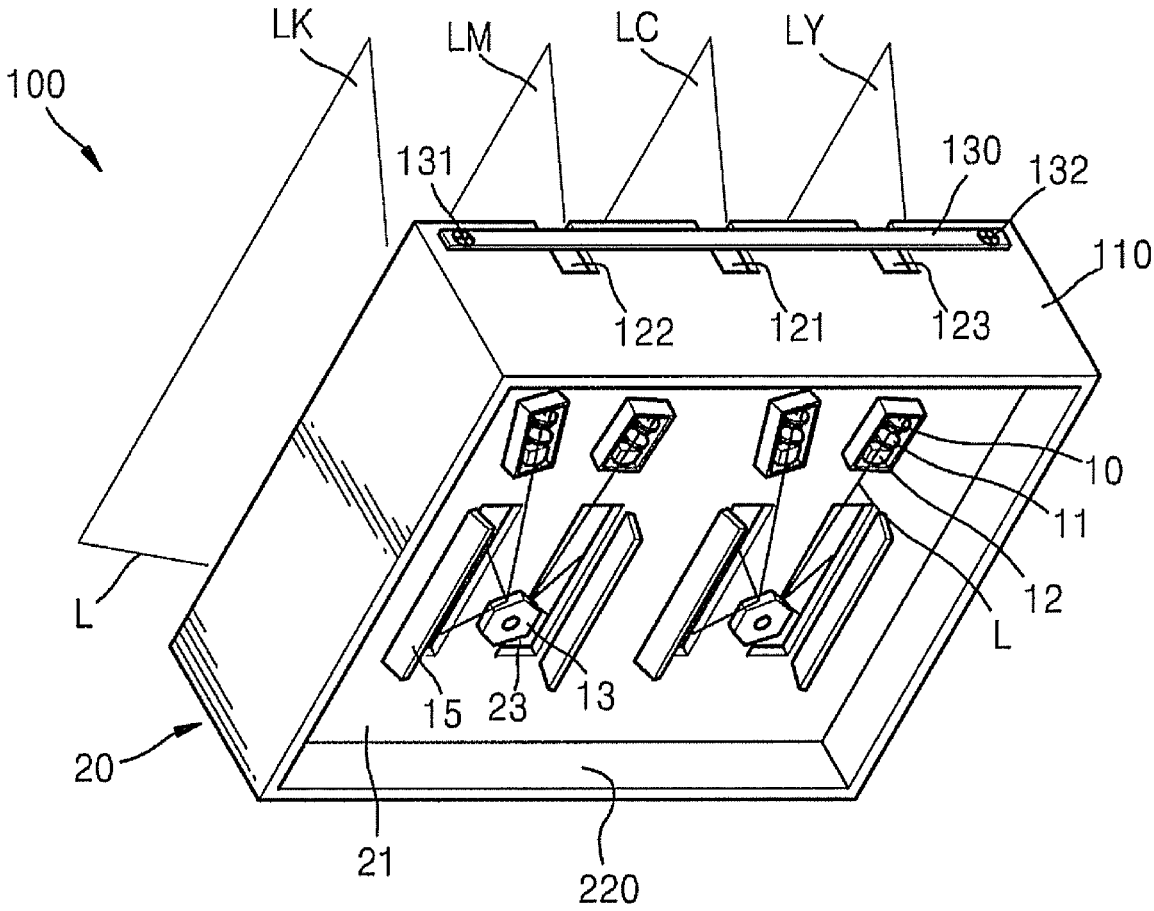
FIG. 1 is a perspective view of a light scanning unit viewed from below, according to an embodiment.

Reference will now be made in detail to the embodiments, examples of which are illustrated in the accompanying drawings, wherein like reference numerals refer to the like elements throughout. The embodiments are described below to and explained by referring to the figures.

Figure 2:
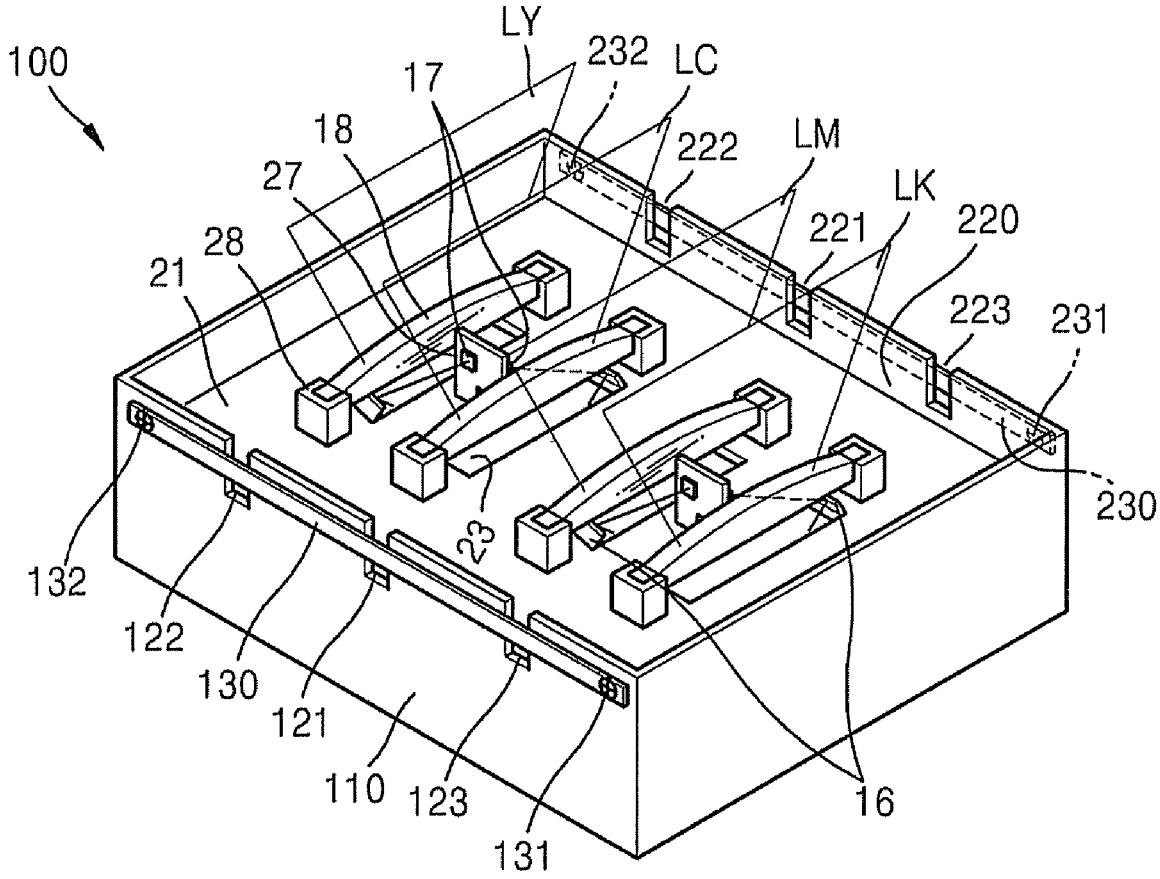
FIG. 2 is a perspective view of the light scanning unit according to an embodiment.
Figure 3:
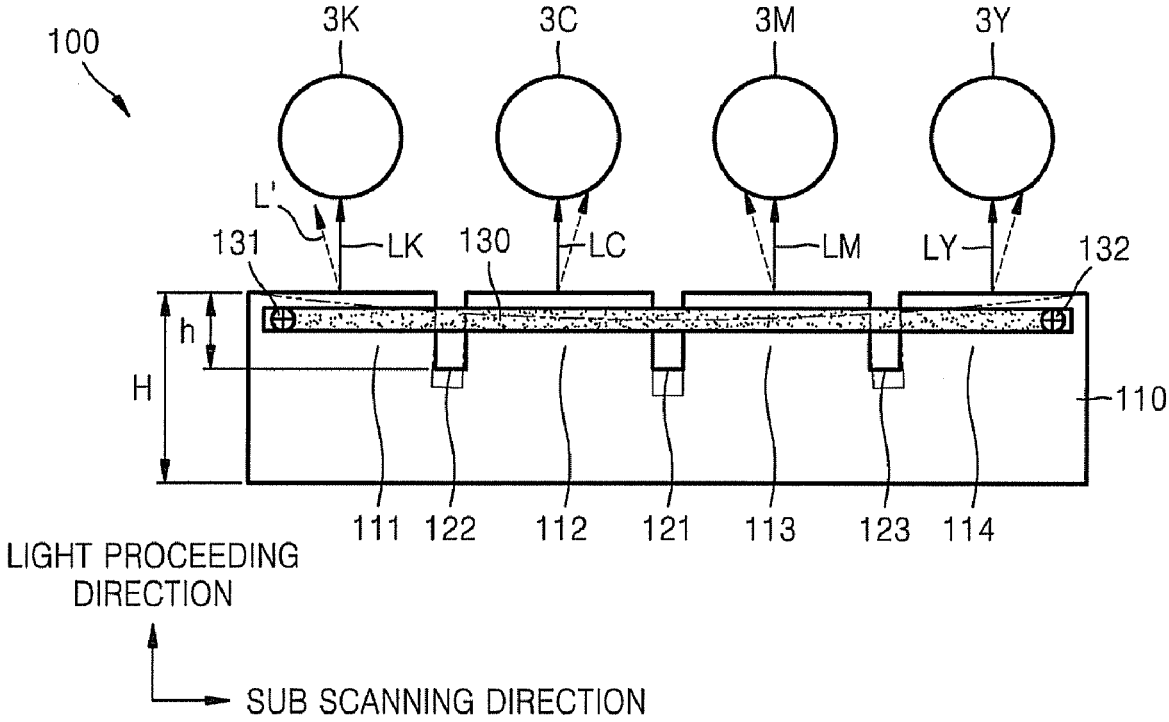
FIG. 3 is a front view of the light scanning unit according to an embodiment.

FIG. 1 is a perspective view of a light scanning unit 100 viewed from below, according to an embodiment. FIG. 2 is a perspective view of the light scanning unit 100 viewed from above, according to an embodiment. FIG. 3 is a front view of the light scanning unit 100 according to an embodiment. FIG. 3 only shows light beams LK, LC, LM, and LY, photosensitive drums 3K, 3C, 3M, and 3Y, slits 121, 122, and 123, and a thermal expansion control unit 130 of the light scanning unit 100, not the optical components shown in FIGS. 1 and 2.

Referring to FIGS. 1, 2 and 3, the light scanning unit 100 includes four light sources 10, two rotary polygon mirrors 13, four synchronization detection sensors 17, four scanning lenses 18, and a housing 20 including these optical components. The light scanning unit 100 also includes four synchronization optical path converting members 16 changing an optical path such that a part of light deflected by the respective rotary polygon mirror 13 proceeds toward the respective synchronization detection sensor 17, and four scanning optical path converting members 15 changing an optical path of light deflected by the respective rotary polygon mirror 13 such that light is scanned through the same surface of the housing 20.

The light sources 10, the rotary polygon mirrors 13, and the scanning optical path converting members 15 are disposed at one side of the housing 20, and the synchronization optical path converting members 16, the synchronization detection sensors 17, and the scanning lenses 18 are disposed at the other side of the housing 20. A supporting member 21 on which optical components are mounted may be disposed between the both sides of the housing 20. The supporting member 21 has openings 23 through which the light reflected by the scanning optical path converting member 15 proceeds toward the other side of the housing 20.

The light sources 10 each may be a laser diode that emits laser light. The rotary polygon mirrors 13 each maybe a beam deflector that deflects light L emitted by the light sources 10 and scans the light L, and may be configured using a polygon mirror with a plurality of deflection surfaces rotatable by a motor (not shown). Since two rotary polygon mirrors 13 are disposed, two laser lights may be respectively deflected using different deflection surfaces. A collimating lens 11 and a cylindrical lens 12 may be disposed on the optical path between the light source 10 and the rotary polygon mirror 13. The collimating lens 11 condenses light emitted by the light source 10 to be collimated or converged. The cylindrical lens 12 may condense the light passing through the collimating lens 11 in directions corresponding to a main scan direction and a sub-scan direction so that an image may be linearly formed on the rotary polygon mirror 13.

The cylindrical lens 12 may include at least one lens. The scanning lenses 18 define an optical imaging system that images light deflected by the rotary polygon mirror 13 on the scanned surface, i.e., on an outer circumferential surface of a photosensitive drum (FIG. 3). The scanning lenses 18 may each be an f-θ lens that images the light on the scanned surface, i.e., on the outer circumferential surface of the photosensitive drum (FIG. 3) and scans light at a constant linear velocity in the main scan direction. A synchronization detection system includes the synchronization optical path converting members 16 and the synchronization detection sensors 17. The synchronization detection system detects a synchronization signal of light deflected by the rotary polygon mirrors 13 in the main scan direction. The synchronization optical path converting members 16 are disposed on each path of laser light between the rotary polygon mirror 13 and the synchronization detection sensor 17 to pass light for synchronous light detection among the light deflected by the rotary polygon mirror 13 toward the synchronization detection sensor 17.

A synchronization detection lens (not shown) condensing the light for synchronization detection may be disposed between the synchronization optical path converting member 16 and the synchronization detection sensor 17. The synchronization detection system is disposed so as to detect a light beam of a starting point in the main scan direction of each light L deflected by the rotary polygon mirror 13. That is, the synchronization optical path converting member 16 is disposed on the optical path and at the scanning starting point of the light L deflected by one deflection surface of the rotary polygon mirror 13.

Four light beams LK, LC, LM, and LY which are emitted by the light scanning unit 100 and respectively correspond to black, cyan, magenta, and yellow are scanned onto four photosensitive drums 3K, 3C, 3M, and 3Y. The four light beams LK, LC, LM, and LY may be arranged in any order. The light scanning unit 100 may be applied to an electrophotographic imaging apparatus forming a color image. An electrostatic latent image is formed on the four photosensitive drums 3K, 3C, 3M, and 3Y and developed by a developer (not shown) to form a developed image, and the developed image is transferred onto an intermediate transfer belt (not shown) to form a color image.

The light scanning unit 100 includes thermal expansion control units 130 and 230.

The housing 20 may be fabricated by injection-molding a plastic. A first side frame 110 of the housing 20 is disposed as one surface of the light scanning unit 100 in a sub-scan direction and has the three slits 121, 122, and 123 formed downward from an upper surface of the first side frame 110 with a predetermined depth, and a second side frame 220 that is disposed on the opposite side of the first side frame 110 has three slits 221, 222, and 223 formed downward from an upper surface of the second side frame 220 with a predetermined depth. The slits 121, 122, and 123 and the slits 221, 222, and 223 are symmetrical to each other. The slits 121, 122, 123, 221, 222, and 223 are formed each between every two adjacent light beams LK, LC, LM, and LY. The first side frame 110 is partitioned by the slits 121, 122, and 123 into external sub-frame portions 111 and 114 and internal sub-frame portions 112 and 113. In the same manner, the second side frame 220 is partitioned by the slits 221, 222, and 223 into external sub-frame portions and internal sub-frame portions.

The thermal expansion control units 130 and 230 are disposed on the first side frame 110 and the second side frame 220 respectively. The thermal expansion control unit 130 is fixed to the external sub-frame portions 111 and 114 of the first side frame 110 by coupling members 131 and 132. Referring to FIGS. 1 and 2, screws are used as the coupling members 131 and 132. However, the coupling members 131 and 132 are not limited thereto.

A thermal expansion coefficient of the thermal expansion control units 130 and 230 is less than that of the housing 20. Thus, if the temperature of the light scanning unit 100 increases during the printing of an image, the first and second side frames 110 and 220 of the housing 20 are easily deformed by the heat. However, the thermal expansion control units 130 and 230 are less deformed since they have a lower thermal expansion coefficient than the first and second side frames 110 and 220. Thus, the deformation of the housing 20 is inhibited by the thermal expansion control units 130 and 230, and thus the housing 20 is deformed in the sub-scan direction. The first side frame 110 may be bent upward or downward. Referring to FIG. 3, the first side frame 110 anticlinally bends, i.e., bends downward, as shown with phantom lines. Although not shown herein, the second side frame 220 is bent in the same manner as the first side frame 110.

The bending of the first and second side frames 110 and 220 may become more serious due to the slits 121, 122, 123, 221, 222, and 223. That is, the thermal expansion control units 130 and 230 are systematically combined with the slits 121, 122, 123, 221, 222, and 223 so as to aggravate the bending of the first and second side frames 110 and 220. However, if the slits 121, 122, 123, 221, 222, and 223 have a too deep depth h, the strength of the first and second side frames 110 and 220 decreases. Thus, the depth h of the slits 121, 122, 123, 221, 222, and 223 may be in the range of about ¼ to about ⅔ of the height H of the first side frame 110. Meanwhile, the interior and exterior of the first and second side frames 110 and 220 are connected to each other through the slits 121, 122, 123, 221, 222, and 223, and thus dust may flow from the exterior into the interior of the light scanning unit 100. In order to prevent the dust inflow, a blocking member (not shown), such as a sticker, that blocks the inflow of dust but does not affect the functions of the slits 121, 122, 123, 221, 222, and 223 may be attached to the slits 121, 122, 123, 221, 222, and 223.

The first side frame 110 is deformed to bend downward by the thermal expansion control unit 130 and the slits 121, 122, and 123. Accordingly, an abnormal scan line L' shown as dotted lines in FIG. 3 is shifted toward a normal scan line LK, LM, LC, and LY, respectively shown as solid lines, so that the change of the scan line may be reduced.

Meanwhile, as a result of observing the abnormal scan line L' shown as the dotted lines when computer simulations are repeated while increasing the temperature of a conventional light scanning unit, the scan lines of the black light beam LK and the cyan light beam LC are deformed in the opposite directions, and the scan lines of the magenta light beam LM and the yellow light beam LY are deformed in the opposite directions. Thus, if the first side frame 110 bends downward, the abnormal scan line L' is shifted toward the normal scan line L, so that the change of the scan line may be reduced.

Figure 4:
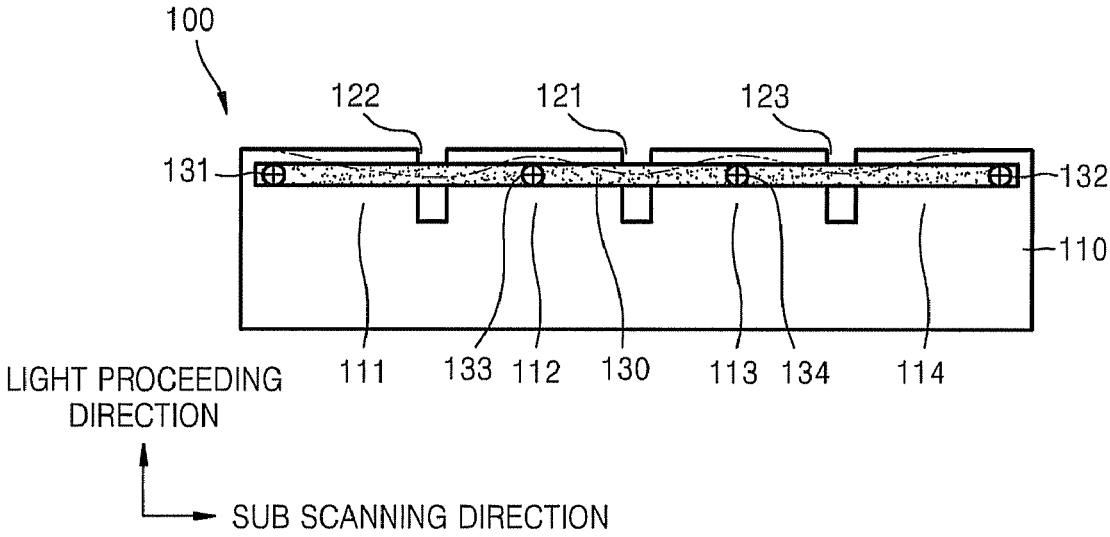
FIG. 4 is a front view of a light scanning unit according to another embodiment.

FIG. 4 is a front view of a light scanning unit 100 according to another embodiment. Referring to FIG. 4, the light scanning unit 100 has the same structure of the light scanning unit 100 of FIGS. 1 and 2, except that the thermal expansion control unit 130 is fixed not only to the external sub-frame portions 111 and 114 with the coupling members 131 and 132 but also to internal sub-frame portions 112 and 113 with coupling members 133 and 134. Thus, the first side frame 110 of the housing 20 may be deformed between the coupling members 131, 132, 133, and 134 as shown with dashed dot lines, which is different from the first side frame 110 of FIG. 3.

According to the configuration described above, the change of the scan line of the black light beam LK and the yellow light beam LY may be reduced and the change of the scan line of the cyan light beam LC and the magenta light bean LM corresponding to the internal sub-frame portions 112 and 113 may also be reduced. In addition, the second side frame 220 of FIG. 3 including the slits 221, 222, and 223 and the thermal expansion control unit 230 may also be applied to the light scanning unit 100 of FIG. 4.

Figure 5:
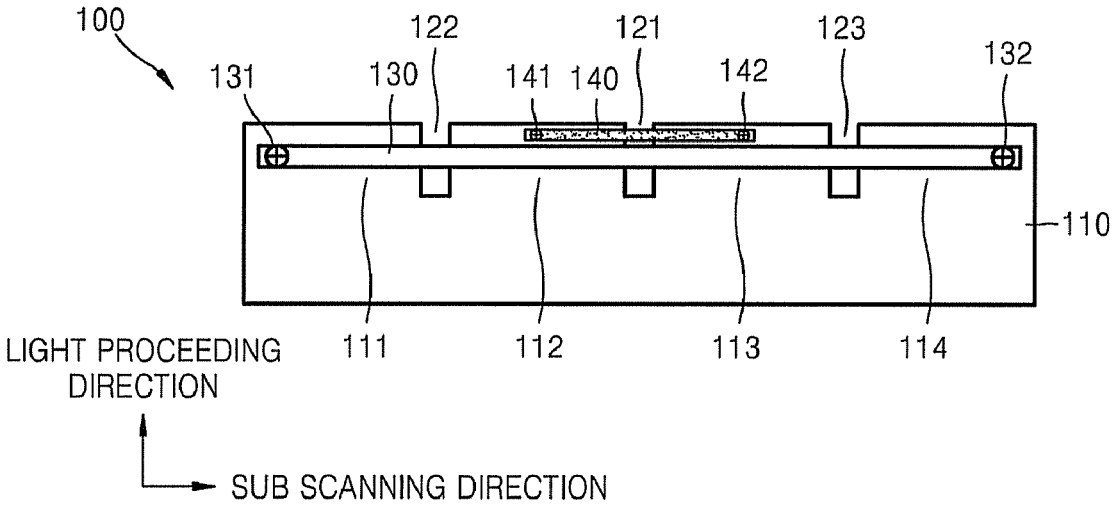
FIG. 5 is a front view of a light scanning unit according to another embodiment concept.

FIG. 5 is a front view of a light scanning unit 100 according to another embodiment. Referring to FIG. 5, the light scanning unit 100 has the same structure of the light scanning unit 100 of FIG. 3, except that an auxiliary thermal expansion control unit 140 is disposed higher than the thermal expansion control unit 130 on the internal sub-frame portions 112 and 113 using coupling members 141 and 142. That is, the auxiliary thermal expansion control unit 140 is disposed closer to the photosensitive drums 3K, 3C, 3M, and 3Y shown in FIG. 1 than the thermal expansion control unit 130. A thermal expansion coefficient of the auxiliary thermal expansion control unit 140 is greater than that of the housing 20. Thus, if the temperature of the light scanning unit 100 increases during the printing of an image, the thermal expansion control unit 130 inhibits the thermal deformation of the housing 20 and causes a bending so as to reduce the change of the scan line of the black light beam LK and the yellow light beam LY, and the auxiliary thermal expansion control unit 140 increases the thermal deformation of the internal sub-frame portions 112 and 113 and causes a bending so as to reduce the change of the scan line of the magenta light beam LM and the cyan light beam LC. In addition, the second side frame 220 of FIG. 3 including the slits 221, 222, and 223 and the thermal expansion control unit 230 may also be applied to the light scanning unit 100 of FIG. 5.

Figure 6:
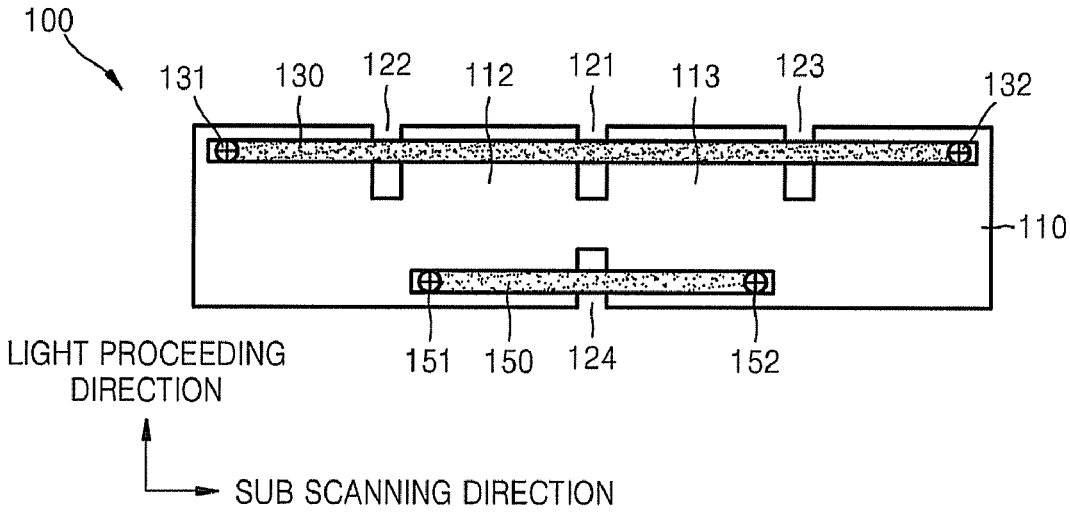
FIG. 6 is a front view of a light scanning unit according to another embodiment.

FIG. 6 is a front view of a light scanning unit 100 according to another embodiment of the present general inventive concept. Referring to FIG. 6, the light scanning unit 100 has the same structure of the light scanning unit 100 of FIG. 3, except that an auxiliary thermal expansion control unit 150 is disposed lower than the thermal expansion control unit 130 on the internal sub-frame portions 112 and 113 using coupling members 151 and 152. That is, the auxiliary thermal expansion control unit 150 is disposed farther from the photosensitive drums 3K, 3C, 3M, and 3Y shown in FIG. 3 than the thermal expansion control unit 130. A slit 124 is formed upward from the lower surface of the first side frame 110 with a predetermined depth so as to correspond to the slit 121. A thermal expansion coefficient of the auxiliary thermal expansion control unit 150 is the same as that of the thermal expansion control unit 130. Thus, if the temperature of the light scanning unit 100 increases during the printing of an image, the thermal expansion control unit 130 inhibits thermal deformation of the first side frame 110 and causes a bending so as to reduce the change of the scan line of the black light beam LK and the yellow light beam LY, and the auxiliary thermal expansion control unit 150 inhibits the thermal deformation of the lower portion of the internal sub-frame portions 112 and 113 so as to reduce the change of the scan line. In addition, the second side frame 220 of FIG. 3 including the slits 221, 222, and 223 and the thermal expansion control unit 230 may also be applied to the light scanning unit 100 of FIG. 6.

Figure 7:
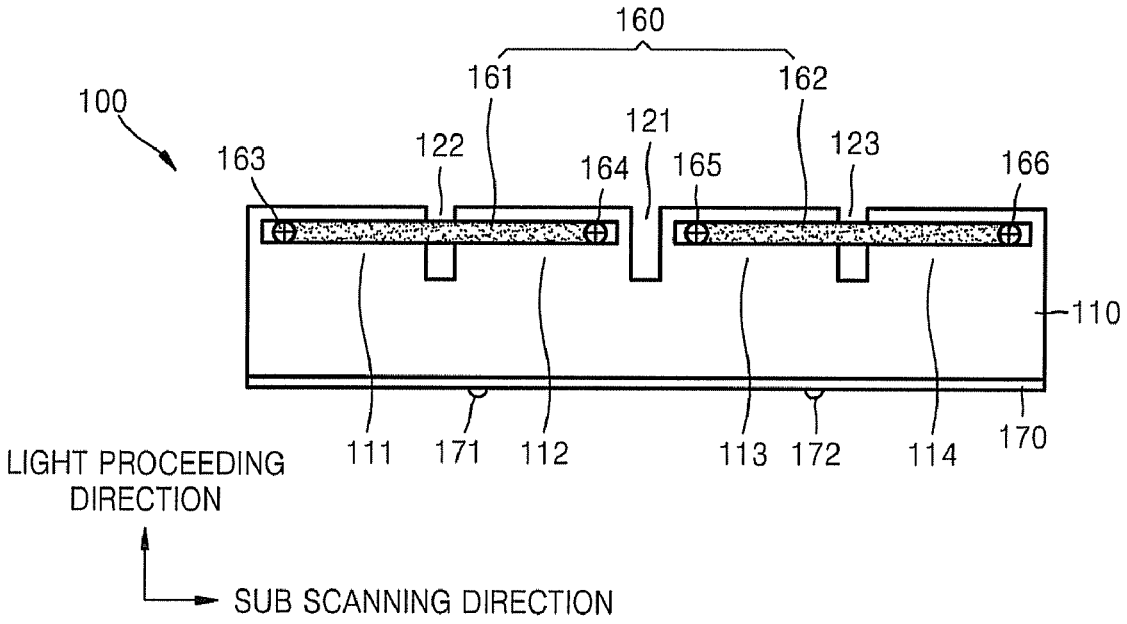
FIG. 7 is a front view of a light scanning unit according to another embodiment.
Figure 9:
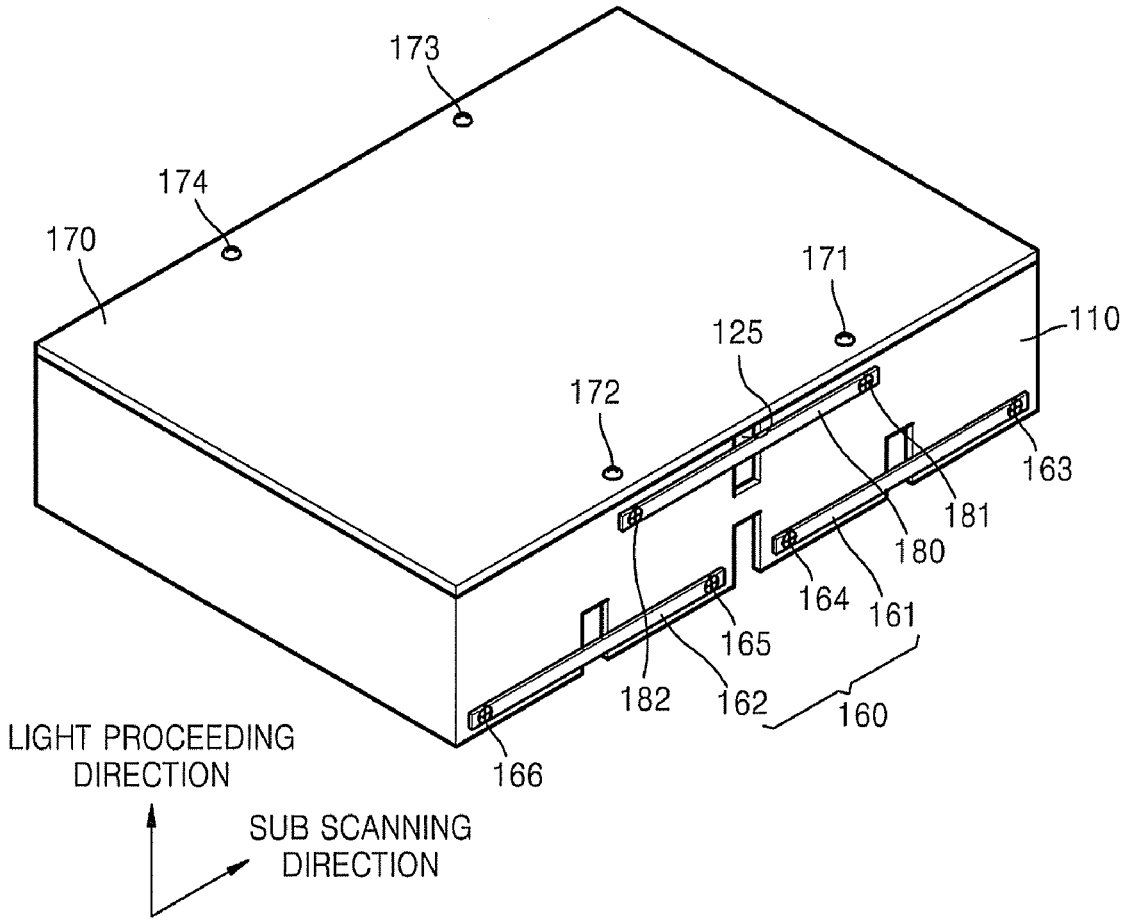
FIG. 9 is a perspective view of the light scanning unit of FIG. 8.

FIG. 7 is a front view of a light scanning unit 100 according to another embodiment of the present general inventive concept. Referring to FIG. 7, the light scanning unit 100 has the same structure of the light scanning unit 100 of FIG. 3, except that a thermal expansion control unit 160 includes a first thermal expansion control unit 161 and a second thermal expansion control unit 162. The first thermal expansion control unit 161 is fixed to the external sub-frame portion 111 and the internal sub-frame portion 112 respectively using coupling members 163 and 164, and the second thermal expansion control unit 162 is fixed to the external sub-frame portion 114 and the internal sub-frame portion 113 respectively using coupling members 165 and 166. A cover 170 is fixed to the lower surface of the housing 20 using coupling members 171, 172, 173, and 174 as shown in FIG. 9. The cover 170 is formed of steel.

The first thermal expansion control unit 161 reduces thermal deformation between the external sub-frame portion 111 and the internal sub-frame portion 112 so as to reduce the change of the scan line of the black light beam LK and the cyan light beam LC. The second thermal expansion control unit 162 inhibits thermal deformation between the external sub-frame portion 114 and the internal sub-frame portion 113 so as to reduce the change of the scan line of the magenta light beam LM and the yellow light beam LY. In addition, the cover 170 is less thermally deformed than the housing 20, and thus is installed on the lower surface of the housing 20 to reduces thermal deformation of the housing 20. Thus, the thermal deformation of the housing 20 may be reduced by the interaction among the first thermal expansion control unit 161, the second thermal expansion control unit 162, the cover 170, and the slits 121, 122, and 123, and thus the change of the scan line of the light beam may be reduced. In addition, the second side frame 220 of FIG. 3 including the slits 221, 222, and 223 and the thermal expansion control unit 230 may also be applied to the light scanning unit 100 of FIG. 7.

Figure 8:
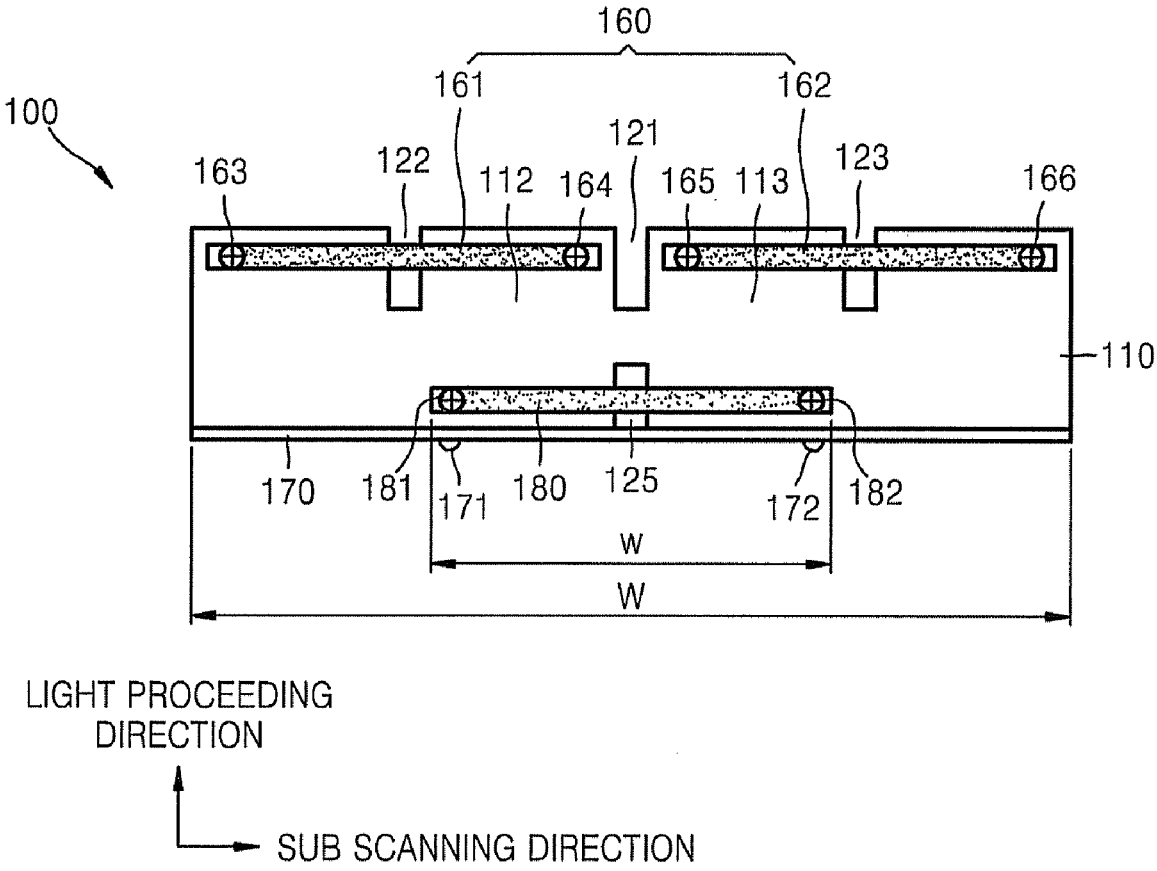
FIG. 8 is a front view of a light scanning unit according to another embodiment.

FIG. 8 is a front view of a light scanning unit 100 according to another embodiment of the present general inventive concept. FIG. 9 is a perspective view of the light scanning unit 100 of FIG. 8.

Referring to FIGS. 8 and 9, the light scanning unit 100 has the same structure of the light scanning unit 100 of FIG. 7, except that an auxiliary thermal expansion control unit 180 is disposed lower than thermal expansion control unit 160 on the internal sub-frame portions 112 113 using coupling members 181 and 182. That is, the auxiliary thermal expansion control unit 180 is disposed farther from the photosensitive drums 3K, 3C, 3M, and 3Y shown in FIG. 3 than the thermal expansion control unit 160. A slit 125 is formed upward from the lower surface of the first side frame 110 with a predetermined depth so as to correspond to the slit 121. A thermal expansion coefficient of the auxiliary thermal expansion control unit 180 is the same as that of the thermal expansion control unit 160. A cover 170 is fixed to the lower surface of the housing 110 using the coupling members 171, 172, 173, and 174 as shown in FIG. 9. The coupling members 171 and 173 are disposed facing each other, and the coupling members 172 and 174 are disposed facing each other. In addition, the coupling members 171 and 172 are disposed to respectively correspond to the coupling members 181 and 182. In addition, the coupling members 171, 173, and 181 are disposed in one line, and the coupling members 172, 174, and 182 are disposed in one line. As such, the change of the scan line of the cyan light beam LC and the magenta light beam LM may be reduced by a thermal deformation-reducing force of the cover 170 and a thermal deformation-inhibiting force of the auxiliary thermal expansion control unit 180 by respectively corresponding the coupling members 171 and 172 of the cover 170 to the coupling members 181 and 182 of the auxiliary thermal expansion control unit 180. In order to reduce the change of the scan line of the cyan light beam LC and the magenta light beam LM, the width w of the auxiliary thermal expansion control unit 180 is set to be ½ of the width W of the first side frame 110. The length of the auxiliary thermal expansion control unit 180 is the same as that of the embodiment of FIG. 6.

The first thermal expansion control unit 161 reduce thermal deformation between the external sub-frame portion 111 and the internal sub-frame portion 112 so as to reduce the change of the scan line of the black light beam LK and the cyan light beam LC. The second thermal expansion control unit 162 inhibits thermal deformation between the external sub-frame portion 114 and the internal sub-frame portion 113 so as to reduce the change of the scan line of the magenta light beam LM and the yellow light beam LY. The auxiliary thermal expansion control unit 180 and the cover 170 inhibit the bending caused by thermal deformation of the lower portions of the internal sub-frame portions 112 and 113 so as to reduce the change of the scan line. In addition, the second side frame 220 of FIG. 3 including the slits 221, 222, and 223 and the thermal expansion control unit 230 may also be applied to the light scanning unit 100 of FIGS. 8 and 9.

Figure 10:
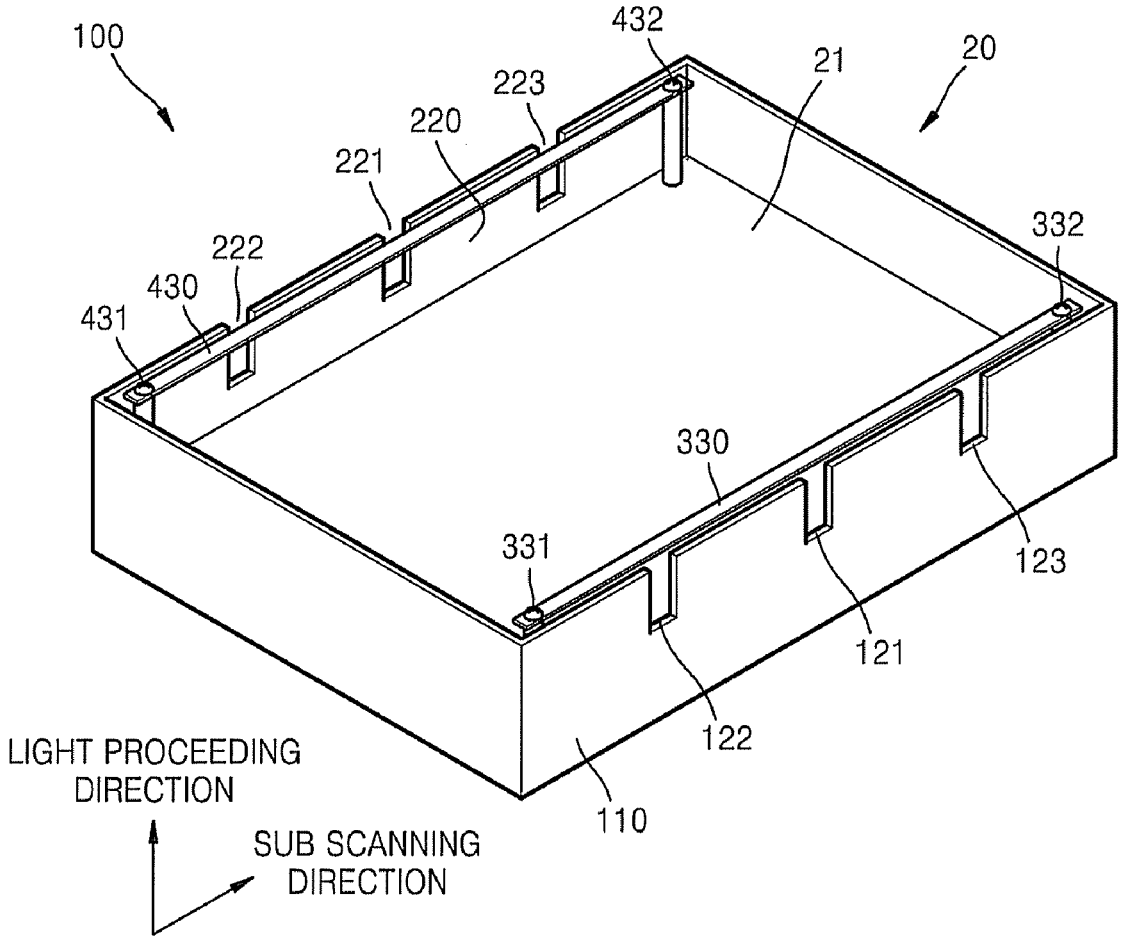
FIG. 10 is a perspective view of a light scanning unit according to another embodiment.

FIG. 10 is a perspective view of a light scanning unit 100 according to another embodiment. Referring to FIG. 10, the light scanning unit 100 has the same structure of the light scanning unit 100 of FIG. 3, except that thermal expansion control units 330 and 430 are disposed not on outer surfaces of the first and second side frames 110 and 220 of the housing 20 as shown in FIG. 3, but disposed on an inner surface of the housing 20 in parallel to the sub-scan direction. The thermal expansion control unit 330 is fixed to a supporting member 21 disposed in the housing 20 via both ends thereof using coupling members 331 and 332, and the thermal expansion control unit 430 is fixed to the supporting member 21 disposed in the housing 20 via both ends thereof using coupling members 431 and 432 such that the thermal expansion control unit 430 corresponds to the thermal expansion control unit 330. Although not shown herein, the cover 170 shown FIGS. 7 to 9, the auxiliary thermal expansion control units 140, 150, and 180 shown in FIGS. 5, 6, and 8 may also be applied to the light scanning unit 100 of FIG. 10. The thermal expansion control units 330 and 430, as the thermal expansion control unit 130 of FIG. 3, inhibit thermal deformation of the housing 20 when the temperature of the light scanning unit 100 increases so as to reduce the change of the scan line of light beams.

As described above, since the change of the scan line due to the thermal deformation may be reduced in a light scanning unit, the light scanning unit may be efficiently applied to electrophotographic imaging apparatuses in any orientation. For example, the light scanning unit may be installed in an electrophotographic imaging apparatus so as to be parallel to or perpendicular to the main body of the electrophotographic imaging apparatus.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A light scanning unit comprising:

a housing comprising optical components disposed on an optical path, wherein an electrostatic latent image is formed by scanning light beams respectively onto a plurality of photosensitive drums, wherein a plurality of slits are formed, in a sub-scan direction, in both side frames of the housing which face each other; and a thermal expansion control unit disposed on at least one of the side frames and having a lower thermal expansion coefficient than a thermal expansion coefficient of the side frames.

2. The light scanning unit of claim 1, wherein the thermal expansion control unit is fixed to each external sub-frame portion among a plurality of sub-frame portions partitioned by the plurality of slits.

3. The light scanning unit of claim 2, further comprising an auxiliary thermal expansion control unit disposed closer to the photosensitive drums than the thermal expansion control unit and having a greater thermal expansion coefficient than the thermal expansion coefficient of the housing.

4. The light scanning unit of claim 3, wherein the auxiliary thermal expansion control unit is fixed to each internal sub-frame portion among a plurality of sub-frame portions partitioned by the plurality of slits.

5. The light scanning unit of claim 2, further comprising an auxiliary thermal expansion control unit disposed farther from the photosensitive drums than the thermal expansion control unit and having the same thermal expansion coefficient as the thermal expansion coefficient of the thermal expansion control unit.

6. The light scanning unit of claim 5, wherein the auxiliary thermal expansion control unit is fixed to each internal sub-frame portion among a plurality of sub-frame portions partitioned by the plurality of slits.

7. The light scanning unit of claim 5, wherein the length of the auxiliary thermal expansion control unit is ½ of the length of the side frame.

8. The light scanning unit of claim 1, wherein the thermal expansion control unit is fixed to each of a plurality of sub-frame portions partitioned by the plurality of slits.

9. The light scanning unit of claim 1, wherein a plurality of thermal expansion control units are symmetrically disposed based on the slit disposed at a center of the side frame.

10. The light scanning unit of claim 9, further comprising a cover formed of steel and covering a lower surface of the housing to reduce thermal deformation of the housing.

11. The light scanning unit of claim 9, further comprising an auxiliary thermal expansion control unit disposed farther from the photosensitive drums than the thermal expansion control unit and having the same thermal expansion coefficient as the thermal expansion coefficient of the thermal expansion control unit.

12. The light scanning unit of claim 11, wherein the auxiliary thermal expansion control unit is fixed to each internal sub-frame portion among a plurality of sub-frame portions partitioned by the plurality of slits.

13. The light scanning unit of claim 11, wherein a slit is formed in both of the side frames on which the auxiliary thermal expansion control unit is disposed such that the slit corresponds to the center of the auxiliary thermal expansion control unit.

14. The light scanning unit of claim 11, further comprising a cover formed of steel and covering the lower surface of the housing to reduce thermal deformation of the housing.

15. The light scanning unit of claim 11, wherein the length of the auxiliary thermal expansion control unit is less than ½ of the length of the side frame.

16. The light scanning unit of claim 1, wherein the plurality of slits are formed each between every two adjacent two light beams respectively emitted toward the plurality of photosensitive drums.

17. The light scanning unit of claim 1, wherein the depth of the slits is in the range of about ¼ to about ⅔ of the height of the side frame.

18. An image forming apparatus having the scanning unit of claim 1.

* * * * *